United States Patent [19]

Proctor

[11] 4,254,652

[45] Mar. 10, 1981

[54] IRONING DIE FOR IRONING PRESS

[75] Inventor: Harry P. Proctor, Minneapolis, Minn.

[73] Assignee: National Can Corporation, Chicago, Ill.

[21] Appl. No.: 43,881

[22] Filed: Jun. 4, 1979

Related U.S. Application Data

[63] Continuation-in-part of Ser. No. 915,611, Jun. 15, 1978, abandoned.

[51] Int. Cl.[3] ..... B21C 3/02

[52] U.S. Cl. ..... 72/467

[58] Field of Search ..... 72/467, 349

[56] References Cited

U.S. PATENT DOCUMENTS

| | | | |
|---|---|---|---|
| 3,167,044 | 1/1965 | Henrickson | 113/46 |
| 4,018,075 | 4/1977 | Kawawa et al. | 72/467 |
| 4,038,859 | 8/1977 | Pavleszek | 72/467 |

FOREIGN PATENT DOCUMENTS

| | | | |
|---|---|---|---|
| 535847 | 1/1957 | Canada | 72/467 |

OTHER PUBLICATIONS

Drawing (No. 250022-C), dated Jul. 1, 1969, by Kaiser Al. and Chem. Corp., Kaiser dwg. No. T-2201.

*Primary Examiner*—Milton S. Mehr

*Attorney, Agent, or Firm*—Robert A. Stenzel; Ralph R. Rath

[57] ABSTRACT

An ironing die for use with a punch to reduce the wall thickness of the sidewall of the metal cup includes a body which has a circular opening therein extending from the leading surface to a trailing surface that are parallel to each other and the opening has a land spaced from both surfaces which defines a minimum diameter for the opening. The opening also has a cylindrical portion between the land and the trailing surface which has a diameter slightly larger than the minimum diameter to guide the cup after the free edge moves past the land. The opening is also flared outwardly between the land and the leading surface to produce an entry portion which guides the cup to a centered position with respect to the ironing land. In one embodiment, the wall which defines the opening also has a cut out portion between the land and the cylindrical portion.

5 Claims, 4 Drawing Figures

IRONING DIE FOR IRONING PRESS

REFERENCE TO RELATED APPLICATION

This application is a continuation-in-part application of U.S. Ser. No. 915,611, filed June 15, 1978, now abandoned.

DESCRIPTION

Technical Field

The present invention relates generally to drawn and ironed containers and more particularly to an improved ironing die for reducing the sidewall thickness of a cup to produce a container that has an integral bottom wall of maximum wall thickness and a sidewall of minimum wall thickness.

In the formation of a "two-piece" container it has been customary to utilize a plurality of die assemblies that cooperate with a punch for converting circular metal discs into finished containers. Usually this is accomplished in two steps. A circular metal disc is originally drawn into a cup utilizing what is commonly referred to as a cupping machine. The cup is then transferred to a body maker or press wherein the cup is converted into the finished container.

One type of body water that is presently being utilized is produced by Ragsdale Bros., Inc. which includes a cup redraw assembly, a plurality of ironing assemblies and a stripper assembly arranged seriatim along a path for a punch. The cups for this machine are originally formed to have a diameter larger than the finished internal diameter of the container and are initially redrawn by the redraw assembly and the sidewall thereof is then reduced in thickness between the punch and the plurality of ironing assemblies. At the end of the stroke for the punch, the end wall of the container is reformed generally to a dome-shaped configuration and the upper free edge of the container is then trimmed to a predetermined height and "necked" and "flanged."

One of the areas that has received a remarkable degree of attention for obtaining accurate and acceptable containers is the uniformity of the sidewall thickness throughout the entire length and diameter thereof. It will be appreciated that in forming conventional beer or beverage containers, the stroke of the punch for the press or body maker must be fairly long and has heretofore created some problems in obtaining a very uniform wall thickness for each container when operating at commercial production rates.

Background Prior Art

In order to alleviate some of the problems in maintaining accurate alignment between the various ironing rings and the punch, it has been proposed to utilize floating ironing die assemblies so that the ironing die can move radially of the path in order to obtain a more uniform sidewall thickness for the finished container. An example of such an arrangement is disclosed in British Pat. No. 724,251, published Feb. 16, 1955, in which the die assemblies are mounted for radial movement to accommodate misalignment between the punch and the ironing rings.

Ironing is a carefully balanced steady state process up to the point where the edge of the cup enters the working portion of the die. Most of the time, this edge is uneven, in magnitude anywhere from a few thousandths of an inch to one-fourth to one-half inch. Obviously, an uneven edge will disrupt this steady state ironing process and several types of failures or process shortcomings show up.

The unevenness of the upper free edge of the cup or can has two sources. One is the cupping operation itself, where it is sometimes caused by tooling inaccuracies or misalignments. The other source is misalignment of the D&I press. Misalignment causes an uneven wall thickness around its circumference. The free edge of the cup or can becomes longer in line with the thinner wall portion because of the accummulation of this surplus metal. The unevenness grows progressively worse as the container moves from one ironing stage to the next. How to cope with this disruptive imbalance caused by the uneven edge is a major difficulty in D&I.

One form of failure caused by the uneven edge is where the longer porton of the edge will tear off entirely. Tear-offs can cause jams of the succeeding cans.

Another very common form, is the punch and die will be forced into a misaligned position due to the non-symmetric forces imposed by the uneven edge. The result is that the longer edge will remain heavier than the wall thickness prescribed by the undisturbed tool gap. In turn, this longer, heavier edge may tear off in the next ironing die.

Another form of failure caused by the uneven edge is dynamic in origin. Invariably the longer part of the edge is thicker than the can wall preceeding it, therefore, since the can travels at a respectible speed, upon impact of this unsymmetric heavy edge on the die, a sudden tool deflection relative between punch and die occurs. This can cause either tear-offs of the longer edge, or smaller type "clip-offs" in the area of the shorter end of the can.

A further form of process failure is that due to the dislocation of the die in relation to the punch, the tools may become damaged. When the shorter edge of the cup oves from between the punch and the ironing die, they may shift sufficiently with respect to each other so that the area of the punch without a container wall thereon is actually in surface contact with the land on the ironing die.

In order to partially alleviate this problem, a pilot die concept has been developed to support the can-punch during the disruptive phase and force a certain degree of ironing of the longer edge. Proceeding in the direction of the punch travel, the centering pilot die is placed behind the ironing die and is mounted in such a way that it forms a rigid assembly with the preceeding ironing die. Such pilot dies are normally only paired up with the middle ironing dies and generally succeed to reduce the thickness of the longer edge to a level where it will not tear off in the end die.

However, because of the very close tolerances that are required to obtain container walls of uniform thickness, this arrangement has been only partially successful in preventing "clip-offs" during a drawing and ironing operation. In order to insure that there is adequate clearance between the periphery of the container wall and the inner opening of the pilot die, the die must normally be made slightly larger than the desired peripheral diameter of the partially formed container after it has passed through the associated ironing die. Furthermore, with separate assemblies, the diameter of the pilot die must be further increased to allow for inaccuracies in alignment of the various parts.

It can be appreciated that in an arrangement such as this, it is virtually impossible to have the openings of the ironing die and the pilot die exactly concentric with respect to each other. Thus, it is virtually impossible to fully accurately align the openings with respect to each other and maintain the openings in the ironing die and the pilot die exactly concentric while at the same time providing for sufficient support with the pilot die to prevent radial shifting of the punch when an uneven cup is passed through the machine.

Almost universally, ironing dies are usually shaped with a lead-in conical surface, a narrow land and an exit conical surface. Ironing is taking place between the lead-in conical surface and the punch. Ironing comes theoretically to an end at the beginning of the land. The effective gap between the internal diameter of the land and the external diameter of the punch determines the wall thickness of the can. However, due to the elasticity of the materials used for the tools, there still is considerable pressure against the wall in the gap which is causing friction. Normally, the axial dimension of the land is preferably maintained as small as possible and is usually on the order of 0.010 to 0.020 inches in length. The conical exit surface immediately relieves the pressure and friction at the end of the die.

SUMMARY OF THE INVENTION

According to the present invention, an ironing die is shaped in a unique configuration, having an integral pilot, so as to support the cup-punch during the critical phase of ironing over the uneven edge, thereby resulting in a more uniform thick wall in the transition to the uneven edge as well as of the longer part of the edge itself. By accurately and effectively controlling the thickness of the long edge through all stages, that is, redraw, first, second and third ironing dies, tear-offs and "clip-offs" are virtually eliminated.

In accordance with the present invention, an ironing die for use with a punch to reduce the wall thickness of the sidewall of a metal cup includes a body that has a circular opening extending from a leading surface to a trailing surface which are substantially parallel to each other and which extend perpendicular to the axis of the punch. The opening in the body has a land spaced from the leading and trailing surfaces which defines a minimumm diameter for the opening and the opening also has a cylindrical portionn that has a slightly greater diameter than the minimum diameter to accurately support and guide the cups while any portion thereof is located within the ironing die band. The diameter of the cylindrical portion should be as close as possible to the diameter of the ironing land but must be large enough to eliminate any substantial degree of friction between the peripheral surface of the cup which is being ironed and the inner surface on the cylindrical portion.

In its specific embodiment, the ironing land is located closer to the leading surface than the trailing surface and the diameter of the cylindrical portion between the land and the trailing surface is on the order of about 1.0001 to about 1.0012 times the minimum diameter of the land. Preferably, this range is on the order of 1.0003 to 1.0010 times the minimum diameter which is defined by the land. Also, the lead in conical working surface has a small angle of 5 to 15 degrees in relation to the land. In some instances, it may also be desirable to have a recess located in the die for the opening between the cylindrical portion and the land.

BRIEF DESCRIPTION OF SEVERAL VIEWS OF DRAWINGS

DETAILED DESCRIPTION

Figure 1:
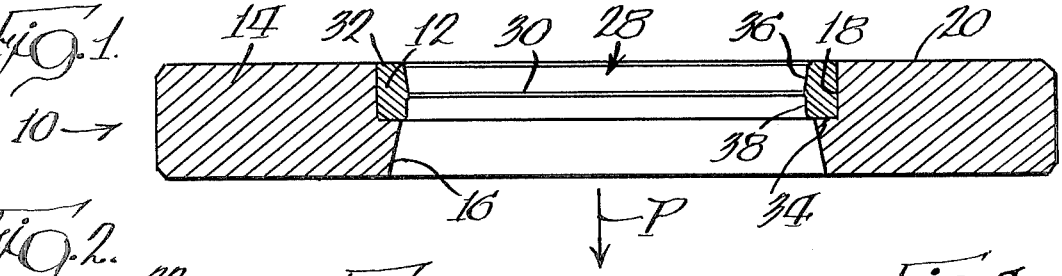
FIG. 1 shows a cross section of an ironing die assembly having the ironing die of the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings generally discloses an ironing die assembly 10 consisting of an ironing die insert 12 supported in a holder 14 which has an opening 16 extending therethrough and an enlarged recess 18 surrounding the opening adjacent the leading surface 20 of the assembly into which the ironing die 12 is received for support thereon.

Usually to reduce the sidewall thickness of a cup, two or three of such assemblies 10 are spaced along a path P for a punch and the sidewall of a cup supported on the punch is reduced in stages to the ultimate thickness for the finished container.

In the past, it has been customary to form the ironing rings with a very narrow land located generally in the center of the ironing die opening substantially equally spaced from the opposite or leading and trailing surfaces of the ironing die, as viewed with respect to the direction of travel of the punch through the ironing die assembly. In order to substantially reduce the amount of friction developed, the land, which actually controls the wall thickness of the cup in cooperation with the punch, is usually made as narrow as possible and in most die assemblies, the areas between the land and the respective leading and trailing surfaces are tapered outwardly slightly so as to further reduce the friction developed during an ironing process.

As was indicated above, when utilizing an ironing die assembly of this type, when a cup is formed with a non-uniform wall thickness or when the upper edge thereof is uneven, during the ironing operation, the shorter edge of the cup will move past the land on the ironing die and because of the extreme forces developed in the ironing operation, the punch and ironing die will move radially with respect to the axis of the punch and can cause tear-offs of the longer edge of the uneven free edge of the cup or clip-offs opposite the long edge. In other instances, even when the longer edge of the uneven cup is not clipped off, the wall thickness thereof will be greater than the wall thickness of the remainder of the cup and this situation will be exaggerated as the cup moves through subsequent ironing dies.

As was indicated above, to partially alleviate this problem, it has been proposed to utilize a separate pilot die assembly adjacent each of the ironing assemblies on the downstream side thereof, as viewed in the direction of travel of the punch with respect to the ironing die.

However, it has been determined that such arrangement is only partially successful in overcoming the inherent problems, particularly when producing containers from cups that have an uneven upper free edge. It has also been proposed to utilize a pilot die member that is secured into an enlarged recess adjacent the trailing side of the ironing die holder for supporting, if needed, the partially ironed cup as it leaves the ironing die. However, this again has only been partially successful and past experience has shown that the moment the short end of an uneven cup passes through the ironing land of the ironing die, a steady state ironing condition is lost which many times can result in damage to the die and/or the punch and can also result in tear-offs and "clip-offs" which may become trapped in the die assemblies and cause jams in the succeeding operation.

According to the present invention, the profile of the opening in the ironing die is constructed in a fashion so as to constrain the container throughout its movement through the ironing die to prevent tear-offs and "clip-offs" and also result in more uniform wall thickness for the finished drawn and ironed container. As most clearly shown in FIG. 2, the profile of the opening 28 (FIG. 1) within ironing die insert 12 consists of a narrow land 30 of minimum axial length to reduce the frictional forces that must be overcome during an ironing operation. Land 30 is spaced from leading surface 32 and trailing surface 34 of the ironing die and the area or surface 36 of the opening between land 30 and leading surface 32 tapers outwardly slightly to produce an increasing diameter between the land and the leading surface and in fact is the working surface that forces a reduction of the incoming wall thickness down to the thickness prescribed by the gap (i.e., difference between land and punch radius).

According to the present invention, the area between the trailing surface 34 and land 30 is cylindrical in shape or has a cylindrical wall portion 38 which has a diameter that is slightly larger than the diameter of land 30, which is the minimum diameter of the opening within ironing die insert 12. The land 30 and cylindrical portion 38 are formed on integral body 12 with an inclined portion 42 located therebetween.

The diameter of cylindrical portion 38 is only slightly larger than the diameter of land 30 and should be just large enough to eliminate any substantial amount of friction between the peripheral surface of the partially formed cup and the inner surface of cylindrical portion 38 while still positively controlling and supporting the cup throughout its movement through the ironing die. The particular relative dimensions of the diameters D1 and D2 are to some measure a function of the elasticity of the tooling utilized, particularly the composite elasticity of the materials for ironing die assembly 10 and the elasticity of the material for the punch (not shown) as well as the material from which the cup is formed. While these parameters have not been fully developed, it is believed that the diameter D2 should be on the order of about 1.0001 to about 1.0012 times the minimum diameter D1 of the opening within ironing die insert 12 and is preferably in the range of about 1.0003 to 1.0010 times the minimum diameter D1.

While not limiting the invention to exact dimensions, an example of a specific profile configuration for an ironing die which has been operated successfully when drawing and ironing aluminum cups will now be given. An ironing die having a thickness of approximately 0.375 inches between the leading surface 32 and the trailing surface 34 had a land of approximately 0.010 inches located intermediate the leading and trailing surfaces and the land had a diameter of 2.6025 inches. The trailing edge of the land 30 was located closer to the leading surface than the trailing surface and the area between the land and the leading surface had an outward taper on the order of 8 degrees per side. The diameter of the cylindrical portion 38 was selected to be 0.0010 inches greater than the diameter of the land and had an axial length of approximately 0.200 inches.

Utilizing three of these ironing assemblies with progressively reducing diameter lands arranged at axially spaced locations with respect to a movable punch, more uniform wall thickness was consistently achieved for the cups that were converted into finished containers and virtually no tear-offs or "clip-offs" were developed during the ironing of a cup into a finished container.

In another test using commercial tooling and the above dimensions, the cylindrical portion 38 was made 0.0016 inches larger than the diameter of the land 30. Again, more uniform wall thickness was achieved for the finished containers and less tool wear was encountered.

In both examples the need for a pilot die in the toolpack was eliminated. This resulted in an overall reduction in cost for the toolpack.

Of course, the respective dimensions could readily be varied without departing from the spirit of the invention. For example, if cups having an uneven edge which would result in a difference of more than approximately 0.200 inches between the shortest and the highest point on the uneven edge where encountered, the length of cylindrical portion 38 could be increased to insure that the container or partially ironed cup would be supported within cylindrical portions at all times when there is any part of the upper free edge of the partially ironed cup within the ironing band 30.

Actual tests have shown that utilizing an ironing die having an inner surface profile of the configuration described above resulted in less tool wear so that the life of the punch and die was increased substantially. At the same time, consistently more uniform wall thickness for each container was achieved.

Figure 2:
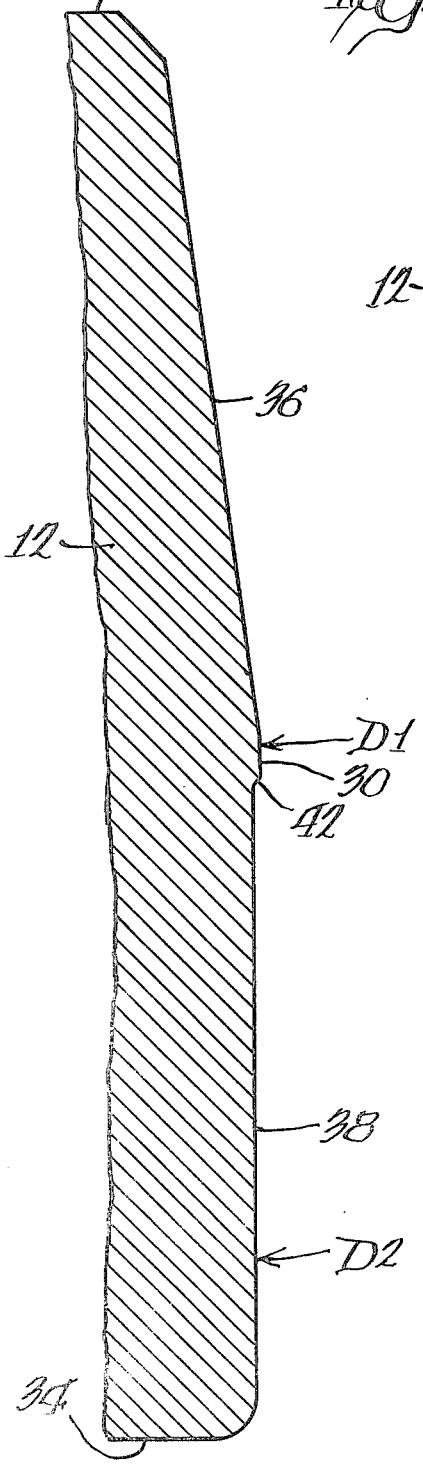
FIG. 2 is an enlarged cross-sectional view of the profile of the opening in the ironing die.
Figure 3:
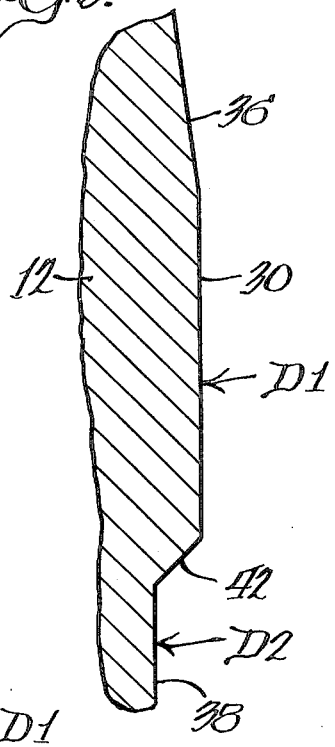
FIG. 3 is an enlarged fragmentary sectional view of the joint adjacent the land of the ironing die.
Figure 4:
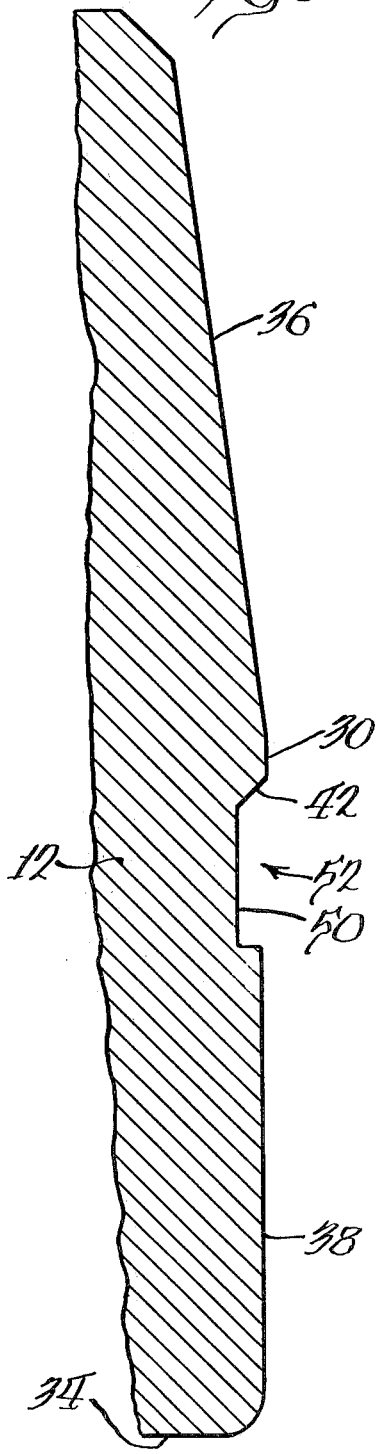
FIG. 4 is a view similar to FIG. 2 showing a slightly modified form of the invention.

A slightly modified form of the invention is illustrated in FIG. 4 and since all elements of the die are identical to the embodiment illustrated in FIG. 2, the same reference numerals have been retained. In the embodiment illustrated in FIG. 4, opening 28 has a cut out portion 50 to produce a recess 52 between land 30 and cylindrical portion 38.

What is claimed is:

1. An ironing die for use with a punch to reduce the wall thickness of the sidewall of a metal cup, comprising a body having a circular opening therein extending from a leading surface to a trailing surface which are substantially parallel to each other, said opening having a land spaced from said surfaces defining a minimum diameter, said opening having a cylindrical portion between said land and said trailing surface having a diameter in the range of about 1.0003 to about 1.0012 times said minimum diameter to guide said cup after a free edge moves past said land.

2. An ironing die as defined in claim 1, in which the spacing between said land and said trailing surface is greater than the spacing between said land and said leading surface.

3. An ironing die as defined in claim 2, in which said opening is flared outwardly between said land and said leading surface to produce an increasing diameter between said land and said leading surface.

4. An ironing die as defined in claim 1, in which the wall of said opening has a cut out portion to define a recess between said land and said cylindrical portion.

5. An ironing die as defined in claim 1, in which the diameter of said cylindrical portion is in the range of about 1.003 to about 1.0010 times said minimum diameter.

* * * * *